US005626541A

United States Patent [19]

Ramlogan et al.

[11] Patent Number: 5,626,541

[45] Date of Patent: May 6, 1997

[54] COLLAPSIBLE ROWING AND NON-ROWING EXERCISE MACHINE

[76] Inventors: Rohit P. Ramlogan, 152-20 79th Ave., Queens, N.Y. 11367; Ali M. Sadegh, 33 Greenway Ct., Closter, N.J. 07624

[21] Appl. No.: 409,458

[22] Filed: Mar. 24, 1995

[51] Int. Cl.[6] ..... A63B 21/06; A63B 69/06

[52] U.S. Cl. ..... 482/72; 482/142; 482/93

[58] Field of Search ..... 482/72, 51, 23, 482/41, 42, 73, 83, 148, 142, 908, 93, 94, 98, 99, 100, 101, 102, 103, 92

[56] References Cited

U.S. PATENT DOCUMENTS

| | | | |
|---|---|---|---|
| 232,022 | 9/1880 | Gifford | 482/72 |
| 1,928,089 | 9/1933 | Blickman | 482/72 |
| 4,564,193 | 1/1986 | Stewart | 482/142 |
| 5,298,004 | 3/1994 | Davis | 482/99 |

*Primary Examiner*—Stephen R. Crow
*Attorney, Agent, or Firm*—Richard A. Joel

[57] ABSTRACT

An exercising apparatus for various rowing and non-rowing exercises having an erected tubular frame comprising two parallel elongated front and back legs, two parallel top and bottom arms, a tubular top, a tubular middle and a tubular bottom axle, a handle and a pulley system, a weight cable system, an extended base, two elongated tracks, and a platform. The said legs are pivotally connected to the top axle that is also connected to the top arms that in turn are pivotally connected to the middle axle and the bottom arms. The bottom axle can slide perpendicularly over the front legs thus creating a folded positions of the arms for rowing exercises or creating an unfolded position of the arms for the non-rowing exercises. The said extended base frame is used as a bases for the platform which is used in the non-rowing exercises. The said base frame also serves as the foundation for a pair of tracks for the wheeled seat which is used in the rowing exercises. Three pulleys are located at the middle of the three axles. The cable system has a weight holder connected to a hook and the cable holder. The cable passes over the pulleys and is connected to the handle for the exercising. The loadings a set of weights and provide free weight movements. The exercise apparatus is foldable and collapses over the plane of the base and can be stored in convenient locations.

7 Claims, 8 Drawing Sheets

Fig 1.a

COLLAPSIBLE ROWING AND NON-ROWING EXERCISE MACHINE

BACKGROUND OF THE INVENTION

1. Field of Inventions

This inventions relates to an apparatus for performing physical exercise to tone all different parts of the body, and more particularly relates to a rowing and pulley system which is adaptable for universal and highly versatile exercises for conditioning various parts of the body. It has long been recognized that regular exercise is needed to maintain the heart, the lungs and the circulatory system in good condition. It is convenient to have this regular exercise at home where the device such as this invention is easily accessible. The present invention is an exercise device which can be easily stored in a house or an apartment since it is foldable and collapsible, after use, and can easily be adjusted to perform rowing and a variety of non-rowing exercises. Also, since all the exercises serve primarily to tone up major muscle groups as opposed to building bulk, as a consequence, not much weight is needed and vertical movements of free weights provide sufficient resistance. Free weights are also used because in this way the resistance throughout each exercise process remains more or less constant over time as opposed to alternative forms, and because the work done can be gauged exactly.

2. Description of the Prior Art

In surveying the prior art, exercising devices are disclosed wherein springs or hydraulic devices are utilized as the force against which the operator must work and which cannot provide a reproducible force. In general, these devices are extremely complicated, heavy and in many cases cannot be folded for convenient storage. Furthermore, most of these prior art devices provide limited types of exercises and are designed for basements and garages where they are inconvenient to use. The following U.S. Pat. Nos. 4,564,193, 3,614,097, 3,558,130, 2,648,540, 1,928,089, and U.S. Pat. No. 232,022 are cited. None of the cited exercise devices simultaneously use free weights, have an adjustable length cable system, allow for the performance of rowing and non-rowing exercises, and is easily collapsible after use.

In view of the foregoing, there exists a need for a universal and highly versatile machine for home usage that is capable of rowing as well as non-rowing exercises to develop and tune the entire body. Therefore, the objective of this invention is to provide an improved exercising device capable of use for a substantial number of exercising functions.

It is a further object of the present invention to provide an exercising apparatus which can be conveniently folded and stored in homes or offices when not in use.

SUMMARY OF THE INVENTION

Briefly described, the invention comprises a tubular frame having two tubular vertical and parallel back legs, two inclined tubular parallel front legs a support, a tubular top axle, horizontal and inclined tubular top and bottom arms, a tubular middle arm axle, a tubular bottom axle, a handle, a base portion which is elongated horizontally and outwardly from one end having a seat and a foot-brace, a weight support and a weight moving vertically along the tubular back legs, a cable means that is adjustable and is attached to the weight support, handle, three pulleys that are attached to the top, middle and bottom axles, and a wheeled seat positioned on the horizontal base for movement therealong as an operator pulls on the cable.

The top arms can be extended horizontally from the top axle and are supported by the bottom arms arms that are attached to the front legs by the bottom axle. The back legs and the front legs are pivotally connected at the top to the top axle, to which the top arms are also pivotally attached. At the other end, these two top arms are pivotally connected to the middle axle to which the bottom arms are also pivotally connected. In turn, the other ends of the bottom arms are pivotally connected to the bottom axle which is attached to the front legs such that it can be made to move up or down on the front legs, thus altering the angle formed by the top and bottom arms.

To fold the exercising apparatus two pins that connect the bottom axle to the front legs are removed, the axle is extended over the front legs, the weight and the weight holder are removed, the front cross bar is removed and thus the whole tubular structure collapses and folds over the extended base.

For the rowing exercise, the top and the bottom arms are fully extended over the front legs and the operator sits on the wheeled seat with feet propped against an adjustable foot-brace, then by grasping the handle connected to the cable, which can be easily increased or decreased in length and which is guided by two pulleys located on the top and the bottom axles, the operator begins a pulling motion with the arms and a pushing motion against the foot-brace with the feet. Accordingly, with these motions the weights will rise and at the point at which the legs are fully extended and the handle is fully pulled, the operator relaxes his/her muscles and the gravitational pull on the weights will return him/her to his/her initial position from which he/she can repeat the maneuver.

Similarly, for the non-rowing exercises, the operator positions himself on the detachable platform, since one's weight is always necessary to help anchor the machine to the floor, and depending on the specific non-rowing exercise being carried out, the operator utilizes the pulley system accordingly.

It is an object of this invention to provide an improved exercising apparatus of the aerobic type which allows the user to perform rowing and a variety of non-rowing exercises utilizing a pulley system and free weights;

It is further object of the present invention to provide an exercising apparatus which can be conveniently folded and stored in homes or offices when not in use.

The objects of this invention will become apparent upon consideration of the drawings provided.

BRIEF DESCRIPTIONS OF THE DRAWINGS

DETAILED DESCRIPTION OF THE PREFERRED EMBODIMENT

Figure 1:
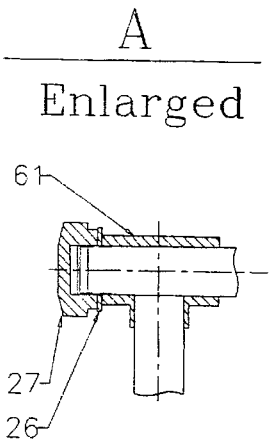
FIG. 1 is a perspective view of machine positioned for rowing exercises.
Figure 1:
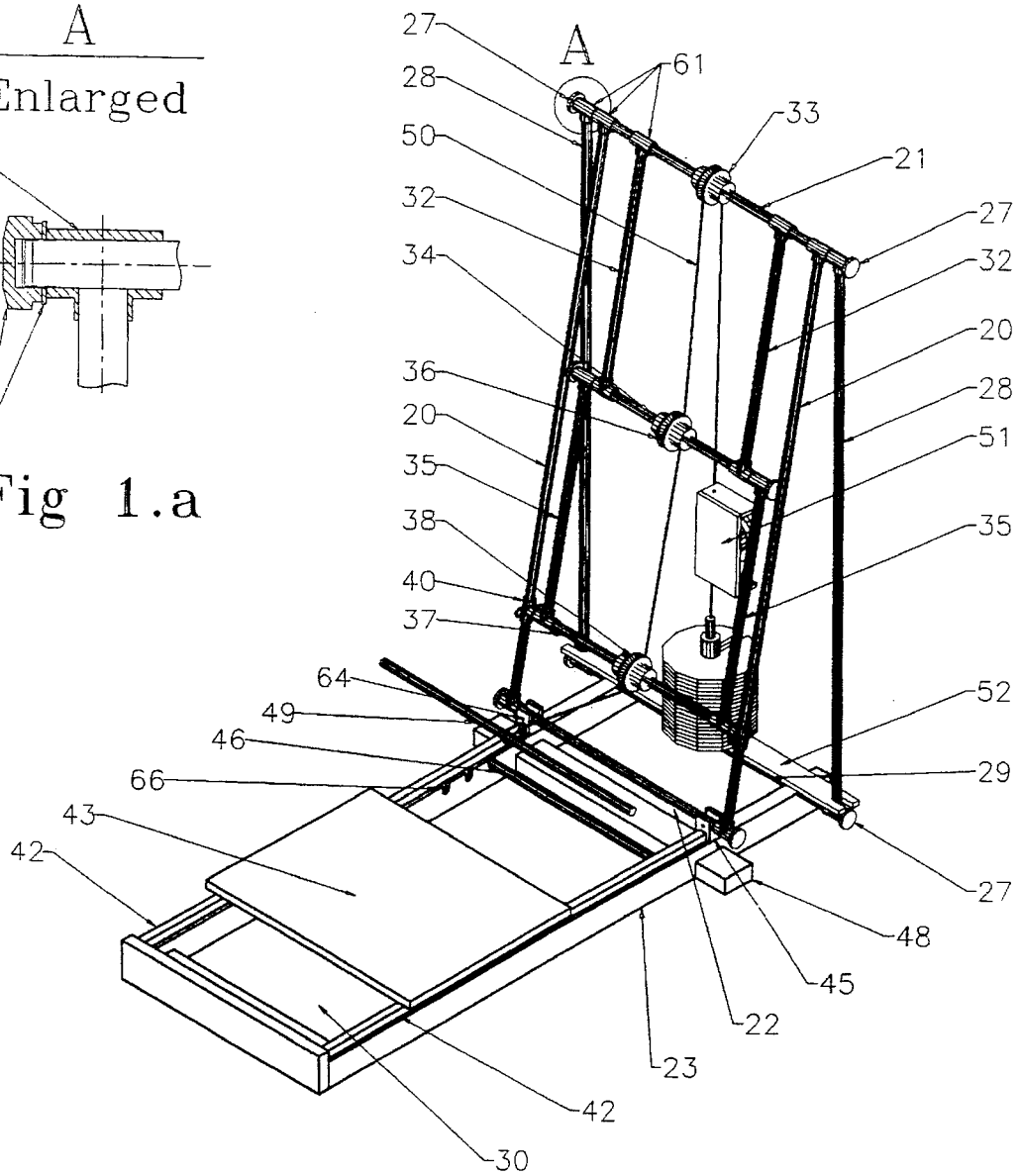
Figure 2:
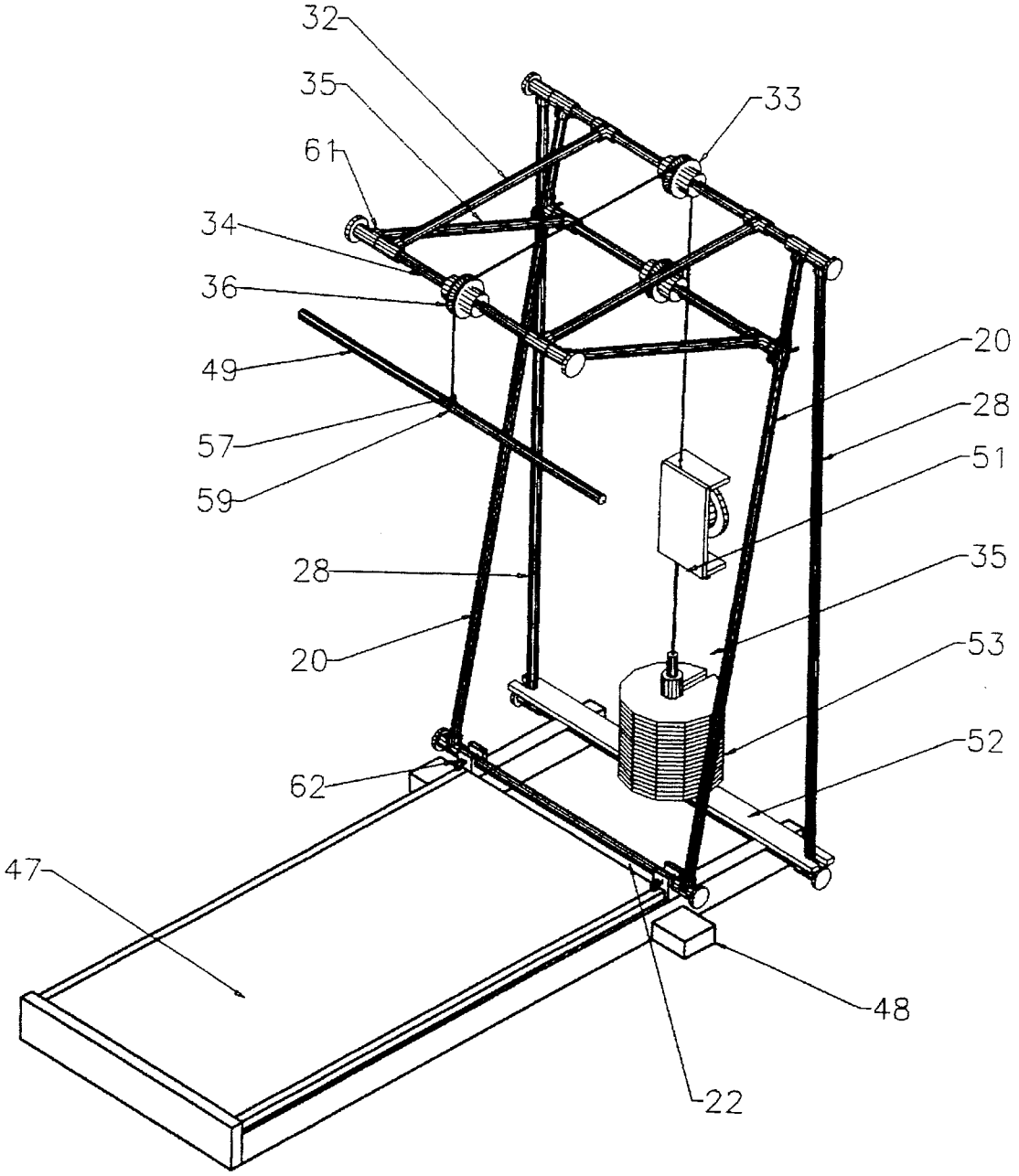
FIG. 2 is a perspective view of machine positioned for a non-rowing exercise.

Referring to FIGS. 1 and 2 the exercising device has generally an upright tubular frame body having two parallel inclined front legs support 20 and two parallel vertical back legs 28, and a base portion 30 which is elongated horizontally and outwardly from one end having a wheeled seat 43 and a foot-brace 46. The two front legs 20 have a series of holes 39 that are at equal intervals for different settings of the apparatus. The two front legs 20 and the two back legs 28 are parallel long cylindrical tubing of the same materials, that have two T-Shaped end tubing 61 at their both ends. The front legs 20 and the back legs 28 are pivotally connected to a top axle 21 by the T-Shaped end attachment tubing 61. At the bottom, the front legs 20 are pivotally attached to a front cross bar 22. The back legs 28 are also pivotally connected, at the bottom, to a back cross bar 29. Two top arms 32 are parallel short cylindrical tubing, approximately half of the length of the front legs 20 and of the same materials, that have the T-Shaped end tubing 61 at their both ends. The top arms 32 are pivotally attached to the top axle 21 and a middle axle 34 through the T-Shaped tubing attachment 61.

Two bottom arms 35 are also parallel short cylindrical tubing, approximately half of the length of the front legs 20 and of the same materials, that have the T-Shaped end tubing 61 at their both ends. The bottom arms 35 are also pivotally attached to the middle axle 34 a bottom axle 37 through the T-Shaped tubing attachment 61.

The top axle 21 is a cylindrical tubing slightly longer than the distance between the two back legs 28 and of the same materials. The axle passes through the T-Shaped end tubing 61 of the back legs 28, the front legs 20, the top arms 32 and a top pulley 33 which is located at the middle of the axle. The ends of the back legs, the front legs and the top arms are pivotally connected to the top axle 21. The top axle 21 has an outer diameter that is slightly less than the inner diameter of the pivotally connecting T-Shaped tubing 61 for smooth pivotal rotation at the joints. To constraint the lateral movements of the pivotal attachments of the front legs, the back legs and the top arms, idle spacing tubes of the same diameter of the T-Shaped 61 are employed. The axle 21 is threaded at both ends and a washer 26 and an end cap screw 27 are utilized at each end of the axle to prevent any lateral movements of all pivotal connections.

The middle axle 34 is also a cylindrical tubing that passes through the T-Shaped end tubing 61 of the top arms 32, the bottom arms 35 and a middle pulley 36 which is located at the middle of the axle. The top arms and the bottom arms are pivotally connected to the middle axle 34. The middle axle 34 has an outer diameter that is slightly less than the inner diameter of the pivotally connecting T-Shaped tubing 61 of the top and the bottom arms, and of the same materials, for smooth pivotal rotation at the joints. To constraint the lateral movements of the pivotal attachments of the top and the bottom arms, idle spacing tubes of the same diameter of the T-Shaped tubing are employed. The axle 34 is threaded at both ends and the washer 26 and the end cap screw 27 are also utilized at each ends of the axle to prevent any lateral movements of all pivotal connections.

Figure 11:
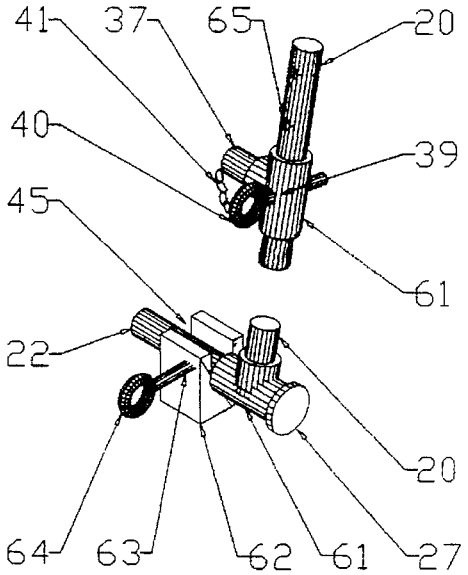
FIG. 11 is a view of the key that locks the front legs and the front cross bar to the base.

The bottom axle 37, is a cylindrical tubing of the same materials as the front legs 20, and it has two T-Shaped end tubing 61 at its both ends. The end of bottom arms 35 are pivotally connected to the bottom axle 37 by the T-Shaped end attachment tubing 61. A bottom pulley 38 is also located in the middle of the axle 37. The bottom axle 37 has an outer diameter that is slightly less than the inner diameter of the pivotally connecting T-Shaped tubing 61 of the bottom arms, for smooth pivotal rotation at the joints. However, the inner diameter of the T-Shaped end attachment tubing 61 of the bottom axle 37 is slightly larger than the outer diameter of the front leg 20 since the end tubing of the bottom axle 37 are supposed to slide over the from legs 20 for either the folding or unfolding positions of the device. As illustrated in FIG. 11, the T-Shaped end attachments of the bottom axle 37 has a hole 39, a pin 40 and a chain 41. The hole 39 correspond to the holes on the from legs 20 that are at equal intervals such that the pin 40 is used to secure the bottom axle 37 to the front legs 20 at different positions through the corresponding holes. FIGS. 1 and 2 show two positions of the bottom axle 37 with respect to the front legs 20 that are secured by the chain and the pin and the corresponding holes.

The front cross bar 22 and the back cross bar 29 are cylindrical tubing which are threaded at both ends and having the outer diameter that is slightly less than the inner diameter of the pivotally connecting T-Shaped tubing 61 of the front and back legs for smooth pivotal rotation at the joints. To secure the pivotal attachments of the front legs 20 and the back legs 28 to the front cross bar 22 and the back cross bar 29, respectively, the washer 26 and the end cap screw 27 are utilized at each ends of the cross bars. The set of washers and the end cap screws prevent any lateral movements of all pivotal connections.

The front cross bar 22 fits snugly in two U-Shaped grooves 45 on a vertically extended portion 62 of the base frame 23 of the base 30 when the apparatus is positioned for use. To secure the front cross bar 22 to the base frame 23 two holes 63 on the extended portion 62 and on the front cross bar 22 are provided such that the two holes are aligned and a pin 64 is inserted through the holes. As best shown in FIG. 11, the pin 64 and the hole 63 also prevents relative lateral motion of the base 30 and the front cross bar 22 which adds to the stability of the structure. The back crossbar 29 is perpendicularly connected to the tip of the base frame 23 of the base 30 through a hole 65 in the base frame 23. Both ends of the back cross bar is threaded and the washer 26 and the end cap screw 27 is used to secure the connection of the back legs 28 to the back cross bar 29.

Figure 3:
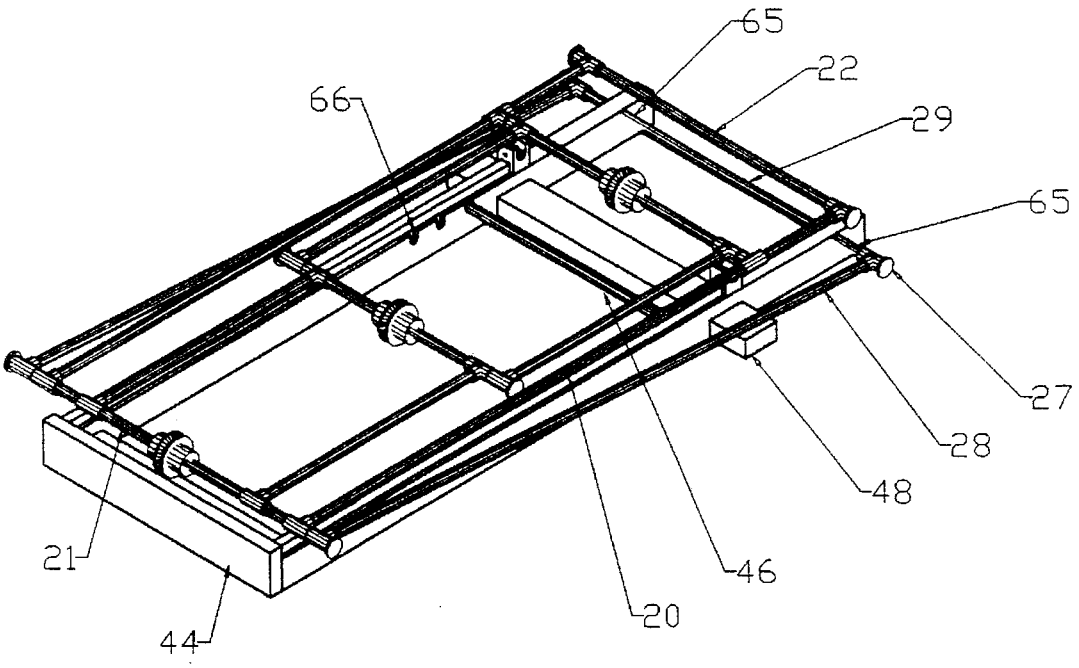
FIG. 3 is a perspective view of machine in a folded position.
Figure 4:
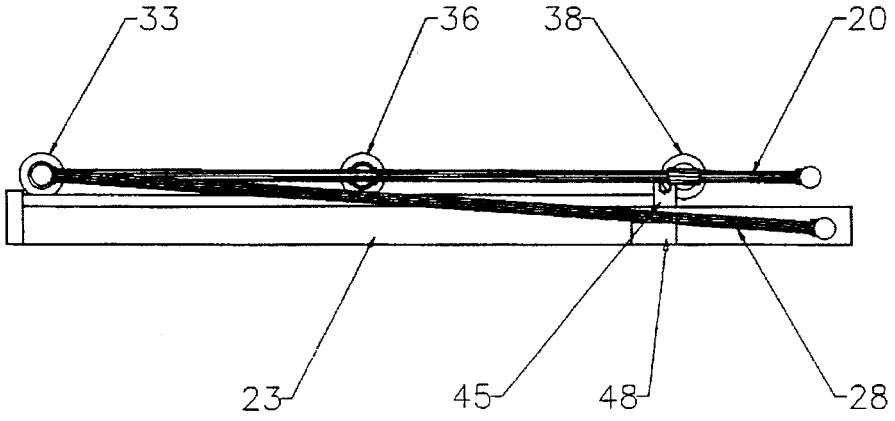
FIG. 4 is a side view of machine in a collapsed position.
Figure 14:
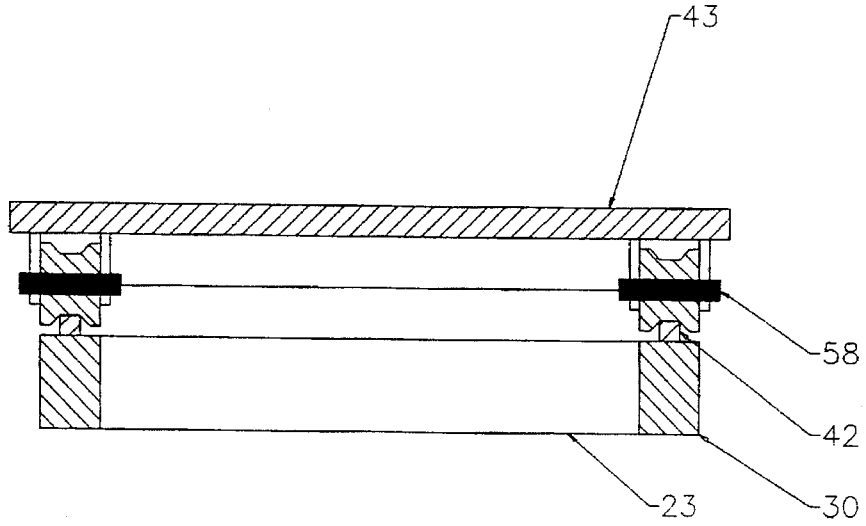
FIG. 14 is a view of the wheeled seat on tracks.

Base 30 having two rectangular elongated sections base frame 23 are rigidly and perpendicularly attached to two bottom cross bars 48 located at the ends and close to the middle of the base frames 23, as shown in FIGS. 3 and 4. Base frame 23 have the two corresponding holes 65 near one end through which the back cross bar 29 passes through, thereby supports the back legs 28. From the back cross bar 29 about halfway towards the midsection, the base 30 is reinforced by the bottom cross bar 48. The base frame 23 are also rigidly and perpendicularly connected by a stopper 44 which also stops a wheeled seat 43 from going off two tracks 42. Rigid connections of the base frames 23 and the bottom cross bars 48 and the stopper 44 create a rigid and strong base 30 for the exercising device. A foot cross bar 46 which is placed perpendicularly into a groove 66 located on the base frames 23 creates a simple foot rest for the operator in the rowing exercises. There are several pairs of grooves 66 on the base frame 23 in order for the operator to adjust his/her foot position in the rowing exercises. Thus the amount of bending of the operator and hence the amount of work done during the rowing exercises varies. The tracks 42 are thin elongated rectangular sections secured to the top of the base frame 23. The two metal tracks 42 are attached longitudinally to the base frame 23 as shown in FIG. 1 and 14. The seat 43 which is placed on the tracks 42 for the rowing exercises consists of a flat rectangular section. Two pairs of wheels 58 are attached to the bottom of the seat 43 such that they can fit upon and be made to roll back and forth on the tracks 42. The seat 43 and the wheels 58 are placed on the tracks 42 for the rowing exercises. The stopper 44, is a short vertical extensions of the bases 30 built to prevent wheeled seat 43 from rolling off the tracks 42.

A platform 47, which is placed between the base frames 23 for use in the non-rowing exercises, consists of a flat rectangular section slightly longer than the tracks 42, on the underside of which are grooves to fit onto the bottom cross bars 48 which holds the base frames 23 together, so that it remains fixed during use. The platform 47 also has grooves on the underside such that it also sits on the insides of the base 30 and becomes level with the tracks 42. Having a leveled surface is necessary in some of the non-rowing exercises where lying on the platform 47 may be necessary. The bottom cross bar 48 are flat rectangular sections which help to hold the base 30 together. In addition, the bottom cross brace 48, which lies near lower front legs 23, is built wider than the base 30 such that it serves to prevent the machine from toppling sideways.

Figure 12:
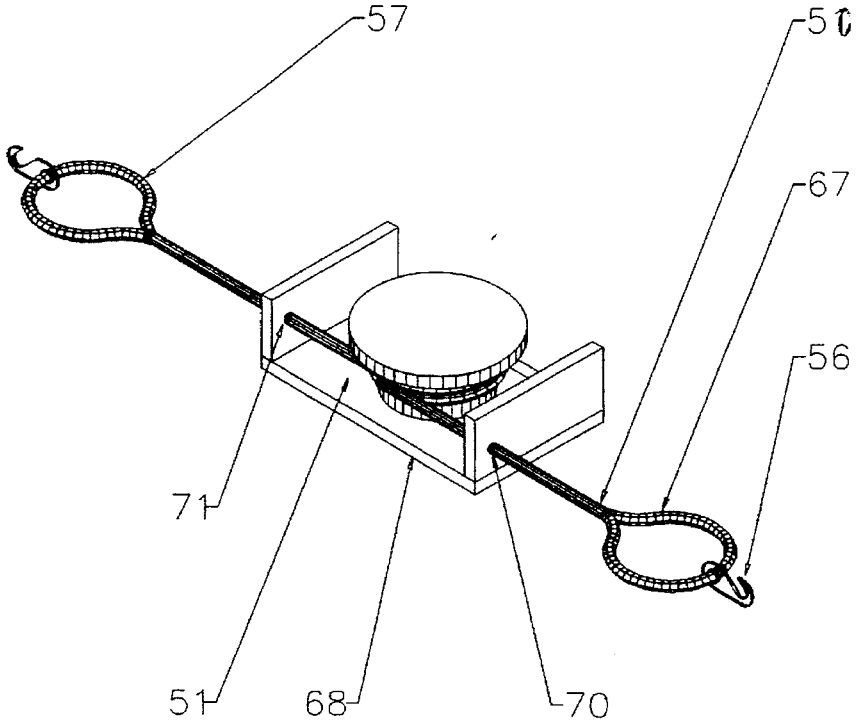
FIG. 12 is a view of the end of the cable with the cable holder and the hook.

A handle 49 is a cylindrical section of about the same diameter as top axle 21 and is slightly longer than the distance between the two front legs 20. It has a hook 59 attached to the middle of the handle such that it can be hooked up with the end loop 57 of a cable 50. The cable 50 has also another loop 67 at the other end as shown in FIG. 12.

In the rowing and non-rowing exercises the gravitational load of the weights are carried through the pulley and the cable system to the operator. FIGS. 1 and 12 show the pulley and the cable system where the cable 50 has a small hook 56 attached to the end loop 67 at one end of the cable, and a loop 57 at the other end. The cable 50 is also attached to a cable holder 51 around which the cable 50 is wrapped. The cable holder 51 is designed for adjustment of the effective length of the cable, that is to say that for some of the exercises that shorter or longer cable is needed one can wrap or unwrap the cable around the cable holder. The cable holder 51 thus allows for a variable length cable system. The cable holder 51 in isolation has a wide short U-Shaped member 68 with a circular section 69 mounted at its center. The circular section is centered such that the cable 50 entering from one side of the cable holder 51 through a hole 70 in the vertical side of the U-Shaped section 68 and is wrapped around the circular section 69 and exits through the other hole 71 in the other vertical side of the U-Shaped section. The cable 50 has the small hook 56 at one end and the large hook 57 at the other end. The small hook 56 of the cable 50 is hooked to a weight holder hook 72 of a weight support unit 52, and the loop 57 of the cable 50 is hooked to the hook 59 of the handle 49. The cable 50 passes over the top pulley 33 located at the middle of the top axle 21, and depending on the rowing or non-rowing exercises the cable 50 also passes either over the middle pulley 36 located at the middle of the middle axle 34 or the bottom pulley 38 located at the middle of the bottom axle.

Figure 13:
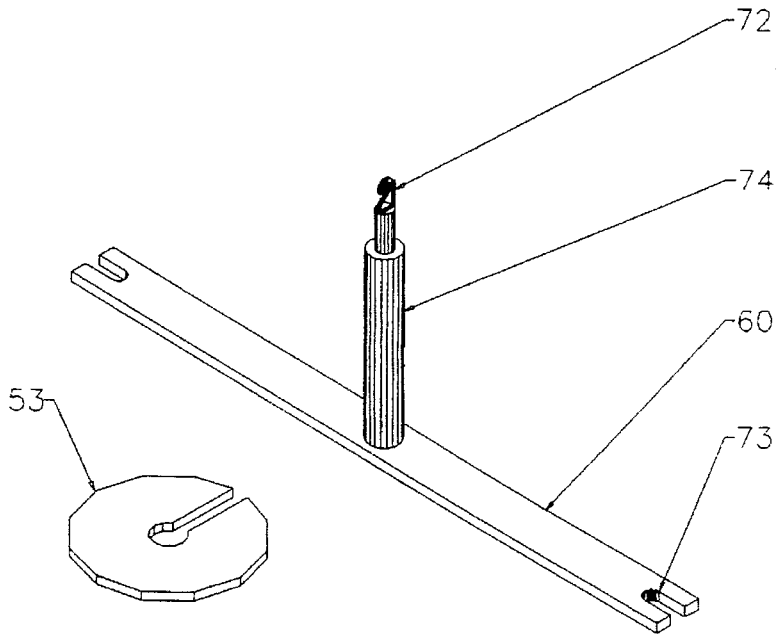
FIG. 13 is a view of the weight support unit and the weight.

FIG. 13 illustrate the weight support unit 52 that resembles an inverted T-Shaped section in isolation. The horizontal part of this unit is a flat rectangular section 60 with circular grooves 73 cut at both ends to enable it to fit onto and slide along the back legs 28. Attached perpendicularly to the middle of this flat section is a short cylindrical section 74 with the weight holder hook 72 at the end to connect to the small hook 56 of the cable 50. It is onto the cylindrical section 74 of the inverted T-Shaped unit that a set of weights 53 are placed. The weight support unit 52 is centered slightly outside the plane defined by the back legs 28 because the cable 50 extending from the top wheel 33 on the top axle 21 falls slightly outside this plane. Hence the center of the weights 53 and the weight support unit 52 which is the cable 50, must lie outside this plane.

In the operation of the present apparatus the operator starts with the folded position illustrated in FIGS. 3 and 4. To unfold and erect the device for the rowing exercise, as shown in FIG. 1, the operator first lifts together front legs 20 and back legs 28 while back legs 28 pivot about back cross bar 29 until they are perpendicular to bases 30. Second, the operator holds one side of back legs 28 with one hand, and slightly tilt it backwards, and with the other hand holding on to one side of front legs 20 tilt front legs 20 forwards until front crossbar 22 which holds front legs 20 at the bottom rests over U-Shaped grooves 45 on base frame 23, and let front cross bar 22 sit in grooves and lock it in position by inserting pin 64 into the hole 63 that goes through 22. Third, make sure top arms 32 and bottom arms 35 lie in same plane as front legs 20, and lock bottom axle 37 to front legs 20 at that position with pin 40. Fourth, the operator slips weight support unit 52 between back legs 28 through a tilting and then leveling process, and slips desired weights 53 onto vertical portion 74 of weight support unit 52. Fifth, the operator attaches end of cable 50 with small hook 56 to weight support unit 52, passes the open end of cable 50 over top pulley 33, under middle pulley 36, and under bottom pulley 38 from the underneath, and adjust cable length as necessary by wrapping excess of cable around middle section 69 of cable holder 51. Sixth, the operator places wheeled seat 43 on tracks 42, attach loop 57 of cable 50 to hook 59 of handle 49, and places crossbar 46 in desired grooves 66 on bases 30.

Figure 5:
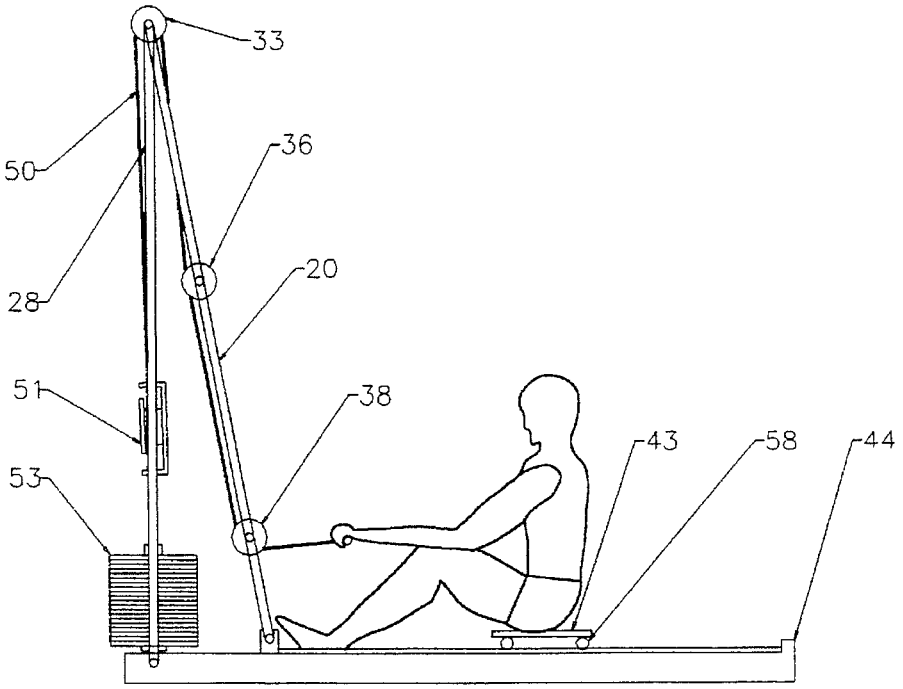
FIG. 5 is a side view of an operator performing rowing exercises.

As illustrated in FIG. 5, the operator can now begin rowing exercises by sitting on wheeled seat 43, holding on to handle 49, and with knees bent and feet resting against cross bar 46, begin a pulling motion with the hands and a pushing motion with the feet. With these motions the weights will rise and at the point at which the feet are fully extended and handle 49 is pulled by the operator's arms, touching the stomach area, all the user has to do is to relax his/her muscles and the gravitational pull on the weights will cause him/her to return to his/her initial position from which he/she can repeat the maneuver.

It is worth noting here that while the gravitational pull on the weights will return the user to his initial position smoothly and gradually, in other forms of resistances, employed in the prior art, the return process will not be smooth. Also, since the rowing exercises which are the most strenuous exercises possible on the machine need no more than about fifty pounds weights for even a strong user, the inconvenience of using free weights become lessened.

Figure 8:
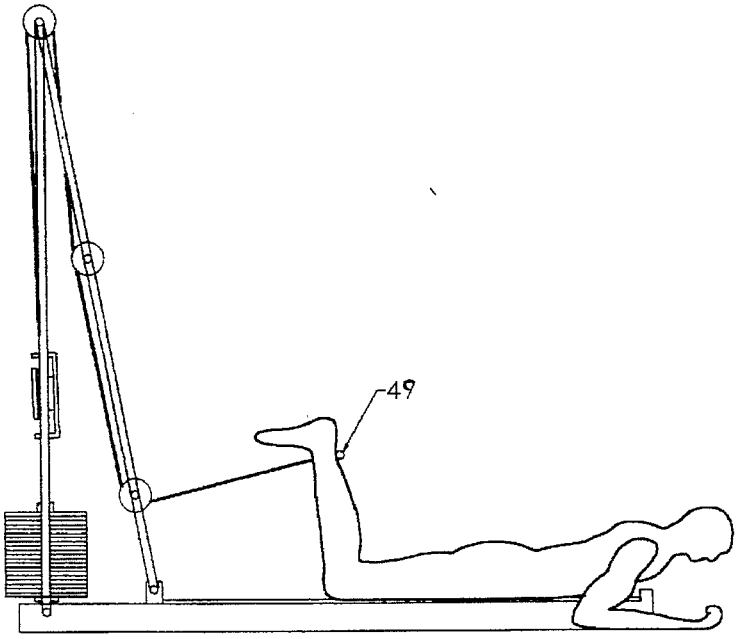
FIG. 8 is a side view of another non-rowing exercise.
Figure 9:
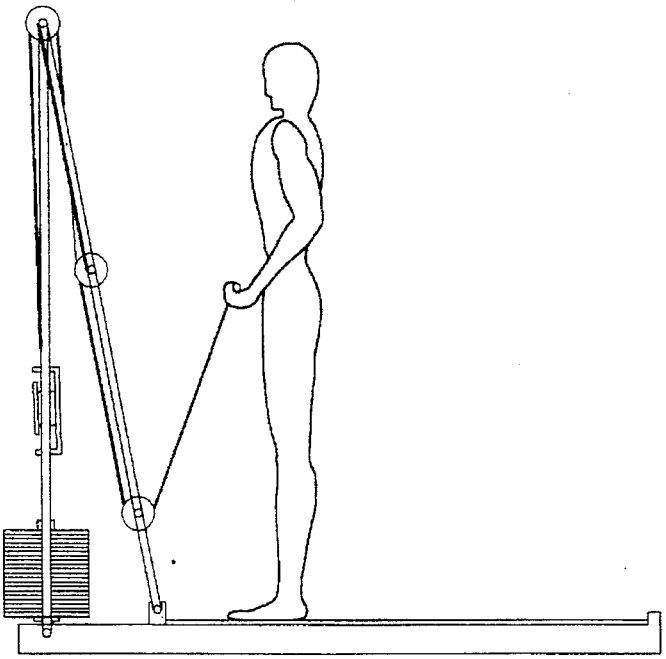
FIG. 9 is a side view of an operator standing on platform performing another non-rowing exercise.
Figure 10:
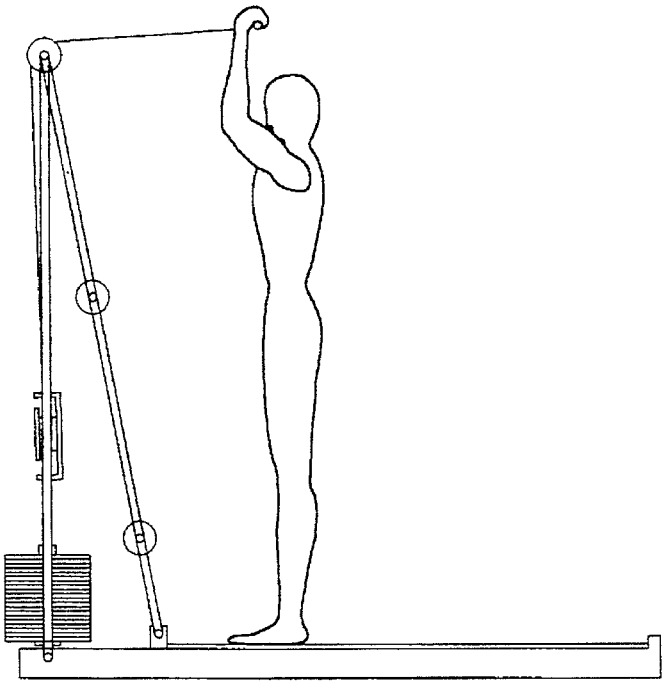
FIG. 10 is a side view of another non-rowing exercise.

FIGS. 8, 9 and 10 illustrate the non-rowing exercises while the apparatus is set up for the rowing exercises. In this case the operator first removes wheeled seat 43 from tracks 42, removes foot cross bar 46, and places platform 47 in position between base frames 23. Second, the operator vary weights 53 as desired and adjust the length of cable 50 by winding or unwinding the cable around cable holder 51. Third, the operator position oneself on the platform and by attaching oneself to the handle 49 which is now hooked up to cable 50. The operator begins exercising according to the positions shown in FIGS. 8, 9 and 10.

Figure 6:
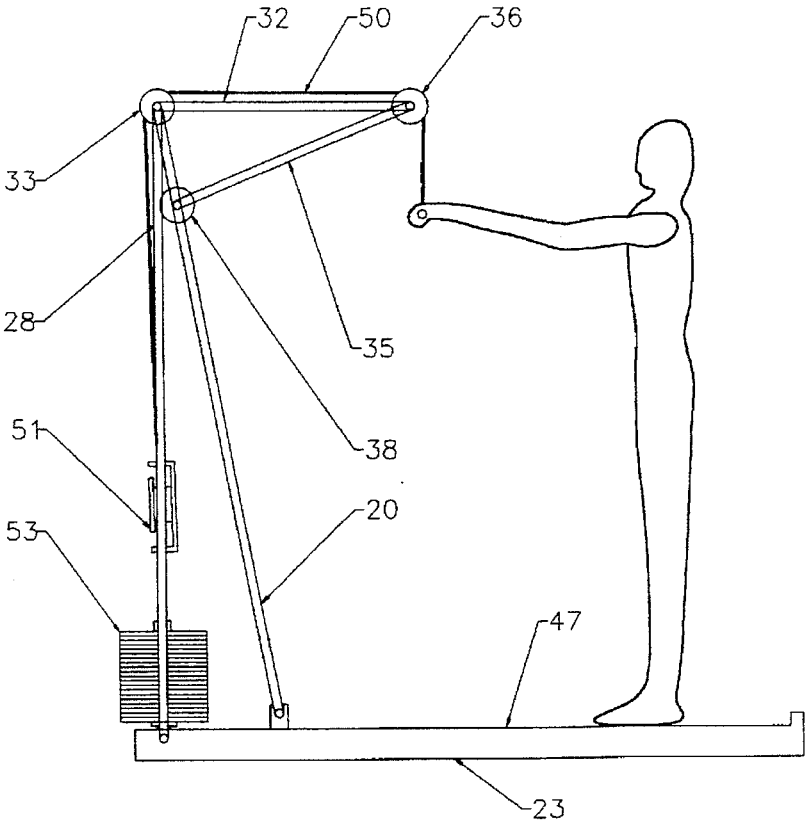
FIG. 6 is a side view of an operator performing non-rowing exercise.
Figure 7:
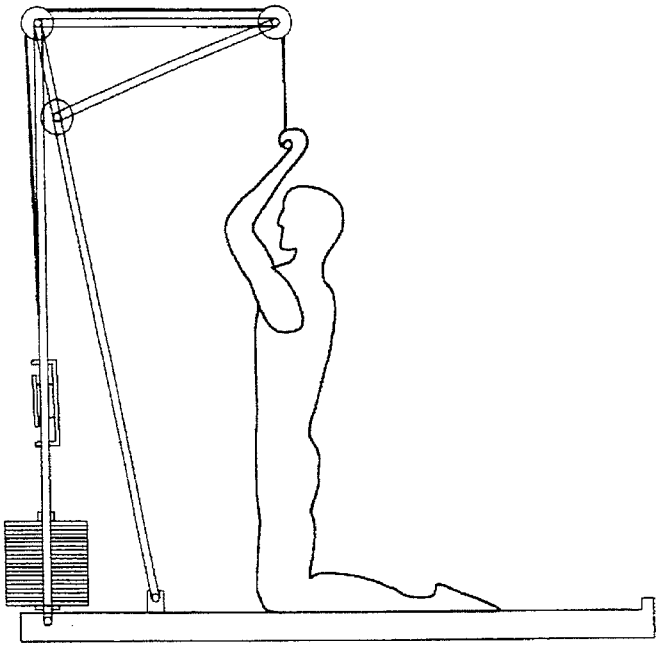
FIG. 7 is a side view of an operator kneeling on the platform and utilizing top and bottom arms in performing non-rowing exercise.

Additional non-rowing exercises can be carried out which involves varying the position of top arms 32 and bottom arms 35 as best illustrated in FIGS. 6 and 7. To set up the apparatus for these non-rowing exercises first the operator removes pin 40 from the hole and moves the bottom axle 37 up along the front legs 20 to the position where the top arms 32 are almost horizontal and insert pin 40 into the corresponding hole on the front legs 20, thereby fixing the position of the bottom axle to the front leg. Third, increase or decrease weight load as necessary and adjusting the cable length, cable 50 passes over the top pulley 33 and the middle pulley 36 and is attached to handle 49. Fourth, the operator places oneself on the platform, and by attaching oneself to handle 49 as shown in FIG. 6 and 7, and begins exercising.

To fold the present apparatus from the non-rowing position to a collapsed position, the operator first, unhook cable 50 from weight support unit 52 and handle 49 and removes cable 50. Then he/she removes platform 47, removes pin 40, that holds bottom axle 37 to upper front arms 20, and let bottom axle 37 slide down front legs 20 until top arms 32 and bottom arms 35 lie in the same plane as front legs 20. Fourth, the operator removes pin 64 from base frame 23 and releases front cross bar 22 from grooves 45, then lifts front cross bar 22 from grooves 45 and position front legs 20 in the same plane as back legs 28. Fifth, the operator allows back legs 28 and upper front legs 20 to slowly fall forward, until top axle 21 sits on bases 30 between end of tracks 42 and stoppers 44. The apparatus is now collapsed.

Thus, an exercise machine has been described which is novel in both form and function, and which is easily storable and can be quickly setup in any convenient area for the use thereof. Further, the disclosed apparatus unlike previous arts employs free weights because of the more positive feedback the operator has in using free weights over alternative forms of resistances.

What is claimed is:

1. An exercising apparatus of the aerobic type for rowing and non-rowing exercises; with a free weight loading system, said apparatus comprising:

(i) an elongated tubular foldable frame body generally having a right angle all triangular shaped portion positioned vertically and having:

(a) two parallel elongated tubular back legs and two parallel elongated tubular front legs, said legs having tubular T-shaped connection at both ends, and said members being pivotally connected to a top axle and front and back cross bars having the bottom ends of said back legs and said front legs bottom ends of said back legs and said front legs pivotally attached thereto;

(b) two parallel elongated tubular top arms having tubular T-shaped connections at both ends and being pivotally connected on the top axle at one and pivotally connected to a middle axle at the other end;

(c) two parallel elongated tubular bottom arms having tubular T-shaped connections at both ends pivotally connected to the middle axle at one end and pivotally connected to a bottom axle at the other end;

(d) wherein said back and said front cross bars and said top axle, and said middle axle are generally elongated tubes threaded at both ends and having an outer diameter that is slightly less than the inner diameter of said T-shaped end tubing for smooth rotation; and, (e) an elongated tubular bottom axle having a tubular T-shaped connection at both ends such that said T-shaped connection easily slides over said front legs, said member having a chain and a pin that is inserted into the holes on the said T-shaped connections and goes through the corresponding holes on the said front legs;

(ii) a stationary horizontal base that is perpendicular to the said vertical tubular frame and having:

(a) two parallel rectangular elongated base frames each having two corresponding holes near one end through which the said back cross bar passes supporting the said legs, the said base frame also having U-shaped grooves for holding the said front cross bar;

(b) two bottom cross bars comprising flat rectangular sections located at the ends and close to the middle of the said base frames and rigidly and perpendicularly attached to the said base frames, and a stopper comprising an elongated rectangular section rigidly connecting the ends of the said base frame;

(c) a base frame including two metal tracks comprising elongated rectangular sections attached longitudinally to the base frame and a wheeled seat located on the said tracks for rowing exercise, and a flat rectangular section platform positioned between the elongated rectangular sections for use in non-rowing exercises; and, (iii) a cable pulley weight system having:

(a) a weight support member comprising an elongated flat rectangular section having a circular groove at each end to fit onto and slide along the said back legs, a short cylindrical section attached perpendicularly at one end to the middle of the said flat section and having a receptor hook at the other end;

(b) a cable having a small hook attached to it at one end and a big hook attached top the other end, a cable holder having the cable wrapped thereabout and including a wide short U-shaped figure with a circular section mounted at its center, said circular section being centered such that the said cable entering from one side and wrapped around the circular section exits through the other hole in the other vertical side of the U-shaped sections, said small hook of the said cable being attached to the said receptor hook of the said weight support section, and the big hook of the said cable being hooked to a handle; and, (c) a pulley located at the middle section of the said top axle, a pulley of the same size located at the middle of the said middle axle, and a pulley located at the middle of the said bottom axle, each engaging the cable.

2. An exercising apparatus as set for in claim 1, wherein: the length of the front and the back legs are twice as long as the length of the top and the bottom arms.

3. An exercising apparatus as defined in claim 1, wherein: both ends of the top axle, middle axle, bottom axle, front cross bar and the back cross bars and cross bars are secured by a washer and an end cap screw to prevent lateral movements of the pivotally connected sections.

4. An exercising apparatus as set forth in claim 1, wherein:

(a) the bottom cross bar located near the lower front legs is wider than said base frame to prevent the machine from toppling sideways.

5. An exercising apparatus as set forth in claim 1, wherein:

(a) said cable holder allows for a variable workable length cable system for various exercises, using said free weight system.

6. An exercising apparatus as set forth in claim 1, further including:

(a) means for adjusting the relative position of the said bottom axle with respect to the said front legs for the rowing and non-rowing exercises.

7. An exercising apparatus as set for in any one of claims 1, 2, 3, 4, 5, and 6, comprising three positions:

(a) a rowing exercise position having the said bottom axle fully extended over the said front legs and said top arms and said bottom arms in the plane of the front legs;

(b) a non-rowing exercise position having the said bottom axle sliding upward and the said middle axle and said arms out of plane of the said front legs; and, (c) a folded position wherein the said front and back legs are rotated and collapsed to the plane of the base, thus allowing the apparatus to be stored.

* * * * *